United States Patent [19]

Marlow et al.

[11] Patent Number: 4,895,063

[45] Date of Patent: Jan. 23, 1990

[54] COMPOSITE ARMOR

[75] Inventors: Peter G. Marlow, Harrogate; Melvyn Perry, Wetherby; Donald Jepson, Leeds, all of England

[73] Assignee: Royal Ordnance plc, London, England

[21] Appl. No.: 130,274

[22] Filed: Dec. 8, 1987

[51] Int. Cl.[4] ..... F41H 5/04

[52] U.S. Cl. ..... 89/36.02; 109/84; 428/911

[58] Field of Search ..... 89/36.02, 36.08, 36.13; 109/80, 82, 84, 85; 114/10, 11, 12; 428/911

[56] References Cited

U.S. PATENT DOCUMENTS

| | | | |
|---|---|---|---|
| 796,768 | 8/1905 | Steinmetz | 89/36.02 |
| 3,765,299 | 10/1973 | Pagano et al. | 89/36.02 |

FOREIGN PATENT DOCUMENTS

| | | | |
|---|---|---|---|
| 1120939 | 12/1961 | Fed. Rep. of Germany | 89/36.02 |
| 577785 | 5/1946 | United Kingdom | 109/84 |

*Primary Examiner*—Stephen C. Bentley

*Attorney, Agent, or Firm*—Stevens, Davis, Miller & Mosher

[57] ABSTRACT

A composite armour comprises a forward metal armour plate, a metal armour backing plate spaced from and generally parallel to the forward armour plate and between the forward armour plate and the armour backing plate an array of armour layers each inclined at a substantial angle to the plane of the backing plate.

5 Claims, 1 Drawing Sheet

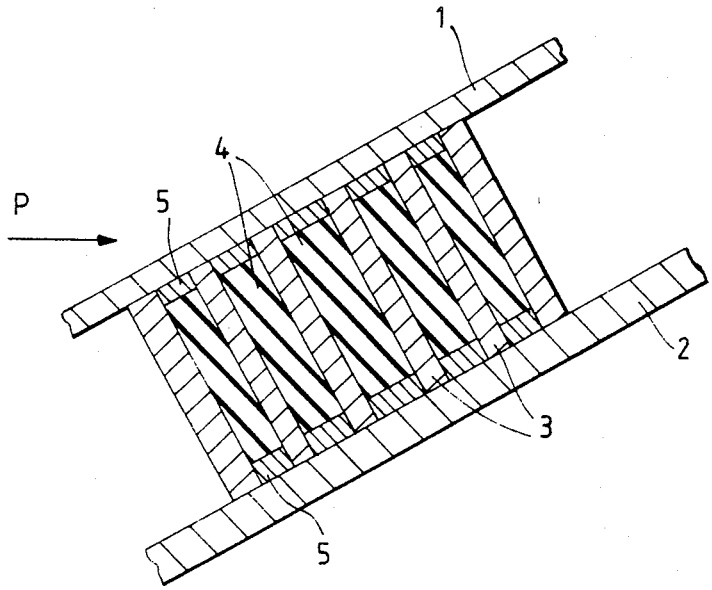
1
4
P
5
2
3
5

COMPOSITE ARMOR

This invention relates to composite armour of the kind comprising a plurality of superimposed layers or plates of differing materials. Such armours can provide considerably increased protection on a weight for weight basis as compared with conventional homogeneous armour plate. These composite armours are particularly effective against chemical energy attack such as by a shaped charge weapon, as well as modern high kinetic energy penetrators.

However, for maximum effectiveness, the plane of the superimposed layers or plates must be inclined with their normal at a substantial angle to the direction of the incoming projectile.

The maintenance of secure fixings under the influence of an inclined high energy attack, and thus maintaining the integrity of the overall armour structure, is a problem because the individual plates and layers tend to slide over one another due to the strong component of the attacking forces parallel to the planes of the layers.

It has therefore been necessary, in order to counter this tendency effectively, to provide very heavy, robust fixings for the individual layers. Not only does this increase the cost, but worse there is a considerable weight penalty. The heavy fixings do not contribute to the overall protective effect in proportion to their weight.

This latter is a serious deficiency especially in the case of an armoured fighting vehicle, in that the speed and mobility upon which the vehicle depends for superiority in combat are impaired.

The present invention seeks to provide a form of composite armour in which these problems are circumvented.

Accordingly the present invention provides a composite armour comprising a forward metal armour plate, a metal armour backing plate spaced from and generally parallel to the forward armour plate, and between the forward armour plate and the armour backing plate, an array of armour layers each inclined at a substantial angle to the plane of the backing plate.

The armour layers will normally be inclined at an angle between 45° and 90° to the backing plate.

The forward and backing armour plates may be for example of rolled homogeneous armour steel.

The armour layers may include spaced metal plates such as rolled homogeneous armour steel of an aluminium alloy armour.

The metal plates may be separated by air spaces, by rubber layers or by other non-metallic layers.

Spacer strips may be fixed, for example by welding, to the surfaces of the forward armour plate and of the armour backing plate so as to locate and maintain the spacing of the metal plates of the array.

In use, the composite armour is oriented so that the normal to the surface of the forward armour plate is inclined at a substantial angle to the direction from which attack is anticipated.

The invention will now be described by way of example only with reference to the accompanying drawing which is a diagrammatic sectional elevation of a composite armour structure in accordance with the invention.

As shown in the drawing, a composite armour structure comprises a forward armour plate of rolled homogeneous armour steel and a backing plate 2 of the same material, which can be part of a vehicle hull or of a turret body. The plates 1 and 2 are substantially parallel and spaced one from the other. The plates are oriented with the normal to their surfaces inclined at an angle of about 60° to the direction P from which an attacking projectile is anticipated.

Between the plates 1 and 2 there are fixed an array of armour layers which are oriented in this example at right angles to the planes of the plates 1 and 2. The armour layers comprise alternate sheets of metal such as rolled homogeneous armour steel, and sheets of non-metallic material such as nitrile rubber. The metal sheets are spaced apart by mild steel spacing strips 5 which are welded to the surfaces of the sheets 1 and 2 at appropriate intervals.

When the composite armour is attacked by a projectile travelling in the direction of the arrow P, the forward armour plate 1 may be penetrated, or high energy spall may be displaced from its rear face. The forward plate 1 will thus be subjected to considerable forces tending to cause it to slide in its own plane, and fragments possessing high energy and moving generally in the direction of the arrow P will travel behind the plate 1 to attack the array of armour layers comprising alternate sheets 3 and 4.

These sheets 3 and 4 are also inclined to the direction P and will resist penetration by these fragments in a similar way to known forms of multi-layer armour. The penetration-resistant mechanism of armours of this type is such that at least some penetrating fragments are deflected through the non-metallic material 4 parallel to the sheets 3. This penetration causes the adjacent layers to expand so that they lock more tightly against one another and against the spacers 5. Furthermore, the movement of the fragments through the layers 4 tends to move these layers 4 as well as the layers 5 in a direction which is entirely different from the sliding movement urged upon the forward plate 1.

The sliding of the component layers across one another under attack is thus resisted by the natural effect of the projectile forcing the armour layers into self rigidity. The layers 3, 4 are supported by the backing plate 2 against relative sliding movement. The strips 5 assist in preventing sliding of the plate 1 over the array 3, 4, and sliding of the array 3, 4 over the backing plate 2.

We claim:

1. A composite armor comprising a forward metal armor plate, a metal armor backing plate spaced from and generally parallel to the forward armor plate and between the forward armor plate and the armor backing plate an array of armor layers each inclined relative to the plane of the backing plate, said armor layers including spaced metal plates separated by layers of non-metallic material and wherein spacer strips are fixed to the surfaces of the forward armor plate and armor backing plate each of which spacer strips extend between an adjacent pair of said spaced metal plates so as to locate and maintain the spacing of the metal plates of said array and wherein each of said layers of non-metallic material substantially fills each space defined by a pair of adjacent said spaced metal plates and a pair of opposed spacer strips whereby relative sliding of the forward armor plate and of the armor backing plate relative to the array of armor layers is resisted due to expansion of said layers of non-metallic material when said composite armor is penetrated by a projectile.

2. A composite armour according to claim 1 wherein the armour layers are inclined at an angle between 45° and 90° to the backing plate.

3. A composite armour according to claim 1 wherein the forward or the backing plates are of rolled homogeneous armour steel.

4. A composite armour according to claim 1 wherein the spaced metal plates are of rolled homogeneous armour steel or aluminium alloy.

5. A composite armor according to claim 1 wherein the forward and backing plates are of rolled homogeneous armor steel.

* * * * *